US007610647B2

(12) United States Patent
Morgan et al.

(10) Patent No.: US 7,610,647 B2
(45) Date of Patent: Nov. 3, 2009

(54) CLEANING SYSTEM

(75) Inventors: Terra J. Morgan, Hales Corners, WI (US); Kara E. Sturdy, Racine, WI (US); Olivia M. Moodycliffe, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 756 days.

(21) Appl. No.: 11/129,132

(22) Filed: May 13, 2005

(65) Prior Publication Data

US 2006/0048319 A1 Mar. 9, 2006

Related U.S. Application Data

(60) Provisional application No. 60/606,951, filed on Sep. 3, 2004.

(51) Int. Cl.
*B08B 1/00* (2006.01)

(52) U.S. Cl. ..... 15/104.94; 15/244.1

(58) Field of Classification Search ..... 15/104.93, 15/104.94, 231, 228, 257.01, 244.1, 210.1, 15/145, 143.1

See application file for complete search history.

(56) References Cited

U.S. PATENT DOCUMENTS

| | | | | |
|---|---|---|---|---|
| 1,534,259 | A | | 4/1925 | Dempsey |
| 2,572,112 | A | | 10/1951 | Coope |
| 2,842,789 | A | | 7/1958 | Wells |
| 4,152,807 | A | | 5/1979 | Smahlik |
| 4,203,857 | A | | 5/1980 | Dugan |
| 4,240,760 | A | * | 12/1980 | Levine ..... 401/201 |
| 4,312,093 | A | | 1/1982 | Raab |
| 4,515,703 | A | * | 5/1985 | Haq ..... 15/104.93 |
| 4,593,427 | A | * | 6/1986 | Ortolivo ..... 15/227 |
| 4,666,621 | A | | 5/1987 | Clark et al. |
| 4,793,019 | A | | 12/1988 | Stima et al. |
| 4,910,825 | A | | 3/1990 | Mauer |
| 4,935,158 | A | * | 6/1990 | Aszman et al. ..... 15/104.93 |
| D316,318 | S | | 4/1991 | Cheang |
| D336,613 | S | | 6/1993 | Zutler |
| 5,419,015 | A | * | 5/1995 | Garcia ..... 15/228 |
| 5,671,498 | A | | 9/1997 | Martin et al. |
| 5,960,508 | A | * | 10/1999 | Holt et al. ..... 15/228 |
| 5,970,560 | A | | 10/1999 | Leroux |
| 5,987,687 | A | | 11/1999 | Kilburn |
| 6,006,761 | A | * | 12/1999 | Meledandri ..... 132/320 |
| 6,607,739 | B1 | * | 8/2003 | Wallo ..... 424/404 |
| 6,687,941 | B2 | * | 2/2004 | Billat ..... 15/220.1 |
| 6,699,825 | B2 | | 3/2004 | Rees et al. |
| 6,807,702 | B2 | | 10/2004 | Keck et al. |
| 7,275,276 | B2 | * | 10/2007 | Jaszenovics et al. ..... 15/104.94 |
| 2003/0070246 | A1 | | 4/2003 | Cavalheiro |
| 2004/0117935 | A1 | | 6/2004 | Cavalheiro |

FOREIGN PATENT DOCUMENTS

| | | |
|---|---|---|
| DE | 1703721 | 12/1971 |
| DE | 3530401 | 7/1986 |
| DE | 3803956 | 8/1989 |
| WO | WO 03/011102 | 2/2003 |

* cited by examiner

*Primary Examiner*—Dung Van Nguyen

(57) ABSTRACT

Disclosed are hand-held scrubbing devices of the type having a replaceable pad. These devices have a handle which is extruded and extremely flexible. The pads are multi-layer and may be pre-impregnated with a cleaner concentrate. A shipping/docking container for use therewith is also disclosed which has the capability of reducing its overall size once the product has reached the consumer.

15 Claims, 10 Drawing Sheets

Release of Cleaner over life of Pad

CLEANING SYSTEM

CROSS-REFERENCE TO RELATED APPLICATIONS

This application claims priority based on U.S. provisional application 60/606,951, which was filed on Sep. 3, 2004.

STATEMENT REGARDING FEDERALLY SPONSORED RESEARCH/DEVELOPMENT

Not applicable

BACKGROUND OF THE INVENTION

The present invention relates to cleaning and other surface treating devices that have a permanent or semi-permanent handle and a replaceable cleaning/surface treating element. More particularly, it relates to such devices that are configured for use in a manner similar to a scrub brush, and to containers useful for shipping, displaying, and storing them.

A variety of cleaning/surface treating devices are known in which a handle removably links to a replaceable cleaning/surface treating element. This is often seen in connection with floor mops having replaceable sponge-like or rag-like heads. Most of these devices attach the replaceable elements to the handle with some form of articulatable joint, and in any event are designed so that the consumer holds the handle at a significant distance from the surface being cleaned. This can make it difficult to use these devices to clean corners around bathtubs, or to clean narrow grooves between wall tiles.

Conventional hand-held scrub brushes can clean such corners and grooves quite well. However, they become dirty and/or smelly over time. Further, such brushes drip after use. Thus, consumers dislike storing them between uses.

There have been attempts to use replaceable cleaning heads with small handles, so as to create compact hand-held scrubbing devices with replaceable cleaning heads. See for example U.S. Pat. No. 5,987,687 and U.S. patent application publications 2003/0070246 and 2004/0117935. However, the cleaning heads and/or the handles used therewith were unduly expensive given the comparative cost to using a permanent structure type scrub brush. Further, they had no optimal storage system for the handle and replacement pads between usage.

In U.S. Pat. No. 1,534,259 there was a disclosure of positioning a polishing cloth attached to a permanent handle on a container. However, that container did not provide a separate housing for the handle before use, nor did the container house replaceable cleaning elements.

U.S. patent D336,613 disclosed a container with a pivotable cover, where the top cover had a well. However, that patent did not suggest that such a well could be used for holding a handle (as opposed to providing a structure compatible with another nested container).

In U.S. Pat. No. 6,699,825 there was a discussion of using hard surface cleaning formulations containing, for example, lactic acid, multiple glycol ethers, surfactant, and fragrance. The disclosure of this patent, and of all other patent publications listed herein, are incorporated by reference as if fully set forth herein. There was also a discussion that such formulations could be used to impregnate wipes. However, there was no discussion in this patent of using such formulations with multi-layer pads, or with such pads linked to handles.

U.S. patent application publication 2003/0070246 described a multi-layer cleaning element. However, that application did not disclose impregnation of an interior layer of the pad with a cleaning liquid, or disclose optimized layer materials.

U.S. Pat. No. 4,593,427 disclosed another multi-layer cleaning structure as used in a different context.

In sum, the art did not provide optimized handles, optimized replaceable pads, or an optimized container system, for a scrubbing/surface treating device having a replaceable contact element.

BRIEF SUMMARY OF THE INVENTION

In one aspect the invention provides a multi-layer surface treating pad. It has an upper layer suitable to serve as one part of a hook/loop type fastener system, an interior layer that is impregnated with a surface treating formula, and a lower layer which comprises an abrasive material. Preferably, the upper layer is suitable to serve as the loop part of a hook/loop type fastener system, the upper, interior and lower layers are welded together or needle punched together around their periphery so that the pad is thicker at its center than at its periphery, the pad is in the form of a cleaning pad, and the formula is a cleaning solution having a carrier liquid, a surfactant and an acid. A variety of other connection techniques are also possible such as welding a line across the center of the pad, or applying adhesive around the periphery of the pads.

The preferred pads can be repetitively wetted and used, while still delivering a high concentration of cleaning ingredients such as the acid. For example, if such a pad is first wetted with water it can release a cleaning solution of at least 1 percent acid by weight. If that same pad is then wetted a second time with water it can still release a cleaning solution of at least 1 percent acid by weight. Moreover, if that same pad is thereafter wetted a third time with water it can still release a cleaning solution of at least 1 percent acid by weight.

The interior layer preferably wicks radially so slowly that it facilitates the attachment of the layers during production. In this regard, in a preferred form the interior layer of the pad is such that prior to said impregnation the interior layer had a wicking characteristic such that if that non-impregnated interior layer had been positioned horizontally and 5 grams of 25° C. water was placed at a center, or within 1 centimeter of the center, of a top surface of the interior layer, that water would not reach a peripheral boundary of the interior layer prior to 1 minute after the 5 grams were so placed.

The cleaning solution may have less than 30 percent water by weight, a glycol ether, an acid such as lactic acid, and a nonionic surfactant. Further, it may be capable of being foamed due to an aerating configuration of the lower layer of the pad.

In another preferred aspect an absorption capacity of the interior layer prior to impregnation with the formula can be over 500% of its starting weight, and the impregnating formula occupies less than 50 percent of the absorption capacity of the interior layer. Hence, a large amount of impregnating formula can be held in the pad (thereby extending the life of the pad), yet there is enough spare absorption capacity to facilitate pick-up of water so as to efficiently dilute the concentrate during use.

In still other preferred aspects the lower layer is formed of a layer of air filter media. This provides an inherent abrasive characteristic, yet passes air in a manner that induces foaming. Another preferred structure is to include polyethylene film linked to a lower side of the upper layer (above the interior layer) to enhance the structural integrity of the upper layer.

In a different aspect the invention also provides a handle suitable to be attached to these replaceable pads. The handle has an extruded flexible main body having an upper head which melds into a narrowed neck below the upper head, the neck melding into a lower base plate. The body is configured and formed such that the neck and a plurality of outer corners of the base plate can all flex. Thus, the handle provides an ergonomic structure which also can facilitate cleaning small crevices. In preferred forms of this structure fastening means are positioned on a lower surface of the base plate, the body is a plastic foam body, the head is generally cylindrical, the base plate is generally rectangular in bottom view, and four outer corners of the base plate can flex.

In yet another aspect the invention can provide a container for storing and shipping such handles and pads. The container has a housing having a first well and a secondary well, the first well being suitable for storing a plurality of cleaning pads and the second well being suitable for storing a handle. The container also has a cover connectible to the housing for essentially closing the first well. There is also a line of weakness between the first and second wells such that the second well can be readily separated from the first well.

The container also has a cover pivotable for essentially closing the first well. When the cover closes the well a top surface of the cover has means for docking a handle thereon.

A preferred impregnation solution is a concentrated cleaning formulation having little or no water. Instead, preferred carriers are the glycol ethers of U.S. Pat. No. 6,699,825. The type of surfactant is not critical.

In one embodiment the solution contains an acid such as lactic acid (which provides certain cleaning properties), a glycol ether (which form the carrier), a nonionic surfactant, and fragrance. In any event, it is desirable that the components be soluble in water so that when the pad is wetted immediately prior to use the chemical will quickly flow to the scrubbing layer of the pad.

It is most preferred for the outer layers to have very low absorption capacity while the middle/interior layer that is impregnated has a higher absorption capacity. This allows the middle layer to retain water when the consumer initially wets the pad, allows the water to mix with the concentrated formula in a controlled manner, and improves foaming characteristics. An absorption capacity for the middle layer of over 500% of its starting weight (preferably over 1000%; even more preferably about 1300%) is preferred.

From a functional standpoint the top layer provides a loop-type attachment system. The middle layer holds the concentrate cleaning fluid, while also providing an empty reservoir to receive water when the pad is wetted (to facilitate foaming and reduce the need for rewetting). The lower layer is a loose abrasive material that performs a scrubbing function, while also aerating the chemical to enhance foaming.

Where polishing rather than cleaning is desired, the chemistry will be correspondingly altered. For example, a standard furniture polish can be used to impregnate the middle layer. Similarly, when other types of surface treatment are desired, corresponding chemistry will be used for the impregnating formula (for example an insecticidal formulation when swabbing a surface with insecticide; an anti-bacterial formulation when sanitizing a surface).

Particularly desirable pads of the present invention can deliver an essentially constant concentration of cleaning or other surface treating liquid when wetted repetitively up to at least three times. Such pads will also have a middle layer that wicks material from the center of the pad to its periphery quite slowly, thereby facilitating enclosure of the middle layer before impregnation liquid has wicked to its radial periphery.

The present invention thus provides cleaning pads, a handle and a container that can be manufactured inexpensively. The pads can be easily affixed to the handle for use, without the consumer needing to contact the pad. Both can be housed in a compact container for shipping and storage. The assembled handle and pad are particularly efficient at cleaning tight corners and narrow grooves between tiles.

The foregoing and other advantages of the invention will become apparent from the following description. In that description reference will be made to the accompanying drawing which forms a part thereof, and in which there is shown by way of illustration preferred embodiments of the invention. These embodiments do not represent the full scope of the invention. Reference should therefore be made to the claims herein for interpreting the scope of the invention.

DETAILED DESCRIPTION OF THE PREFERRED EMBODIMENTS

A. Overview

Figure 1:
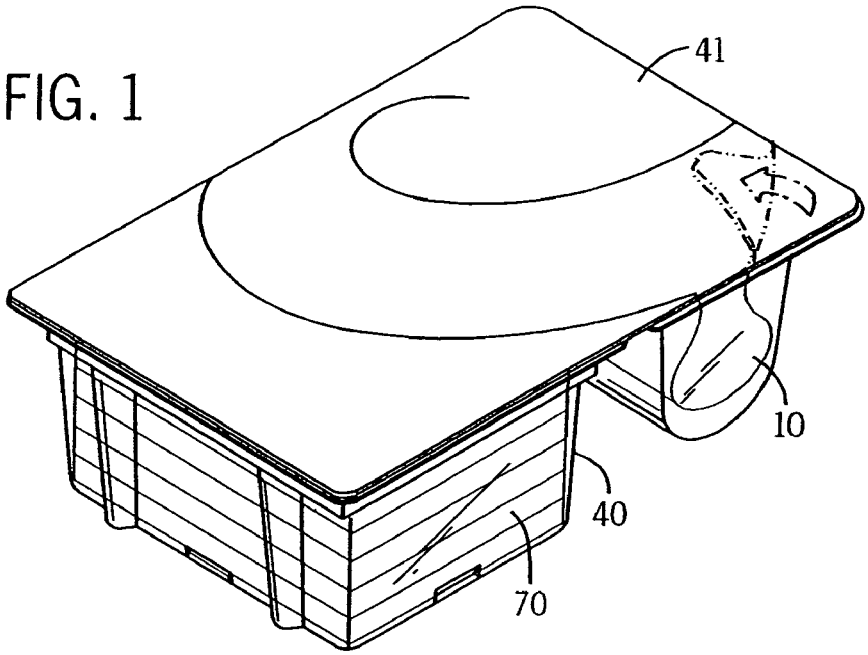
FIG. 1 is a top, left, perspective view of a system of the present invention.
Figure 2:
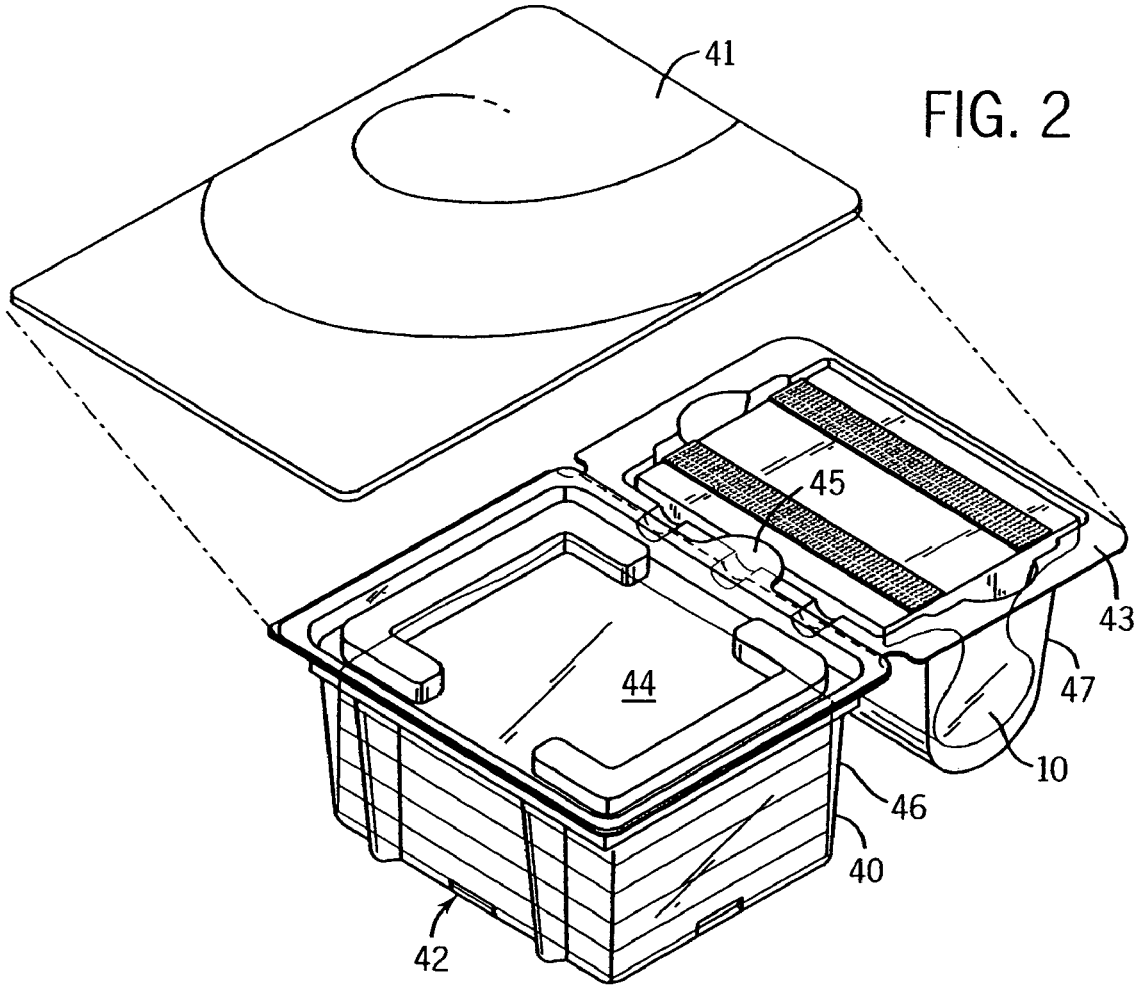
FIG. 2 is a view similar to FIG. 1, but with a display board removed (as a consumer would do when beginning to open the product)

The preferred cleaning system is depicted in the enclosed drawings. As shown in FIGS. 1 and 2, the system has a handle 10, a container 40, and a plurality of multi-layer cleaning pads 70. These features will be described below.

B. The Handle

Figure 12:
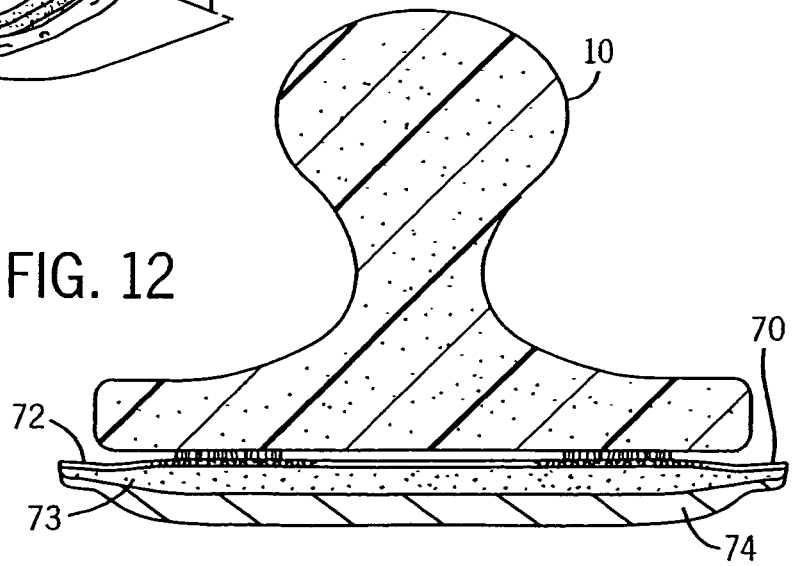
FIG. 12 is a sectional view taken along line 12-12 of FIG. 11.

The handle 10 is almost entirely an extruded body, such as an extruded foam body, most preferably an extruded polyethylene foam body such as a Nomaco polyethylene foam body. The foam can be extruded in a continuous strip having the FIG. 12 profile, then cut into lengths of about 8-16 centimeters, (preferably about 11.5 centimeters). A most preferred foam has a density of between 15 and 35 kilograms/meter$^3$ (preferably a density of about 24 kilograms/meter$^3$).

Because it is extruded, the handle will have a cross section that is uniform throughout its length (except perhaps at the very ends if the cutting is not straight). Because it can be truncated by simple cutting, it is inexpensive to produce. Surprisingly, such extruded foam handles have sufficient stability and integrity to function for their intended purpose for long enough for at least a full stack of ten or so replacement pads to be used without undesirable handle degradation. Yet the foam material is flexible enough to allow the edges and neck of the handle to bend more than 10 degrees (preferably more than 25 degrees) to accommodate room corners and grooves (see FIG. 13).

Figure 3:
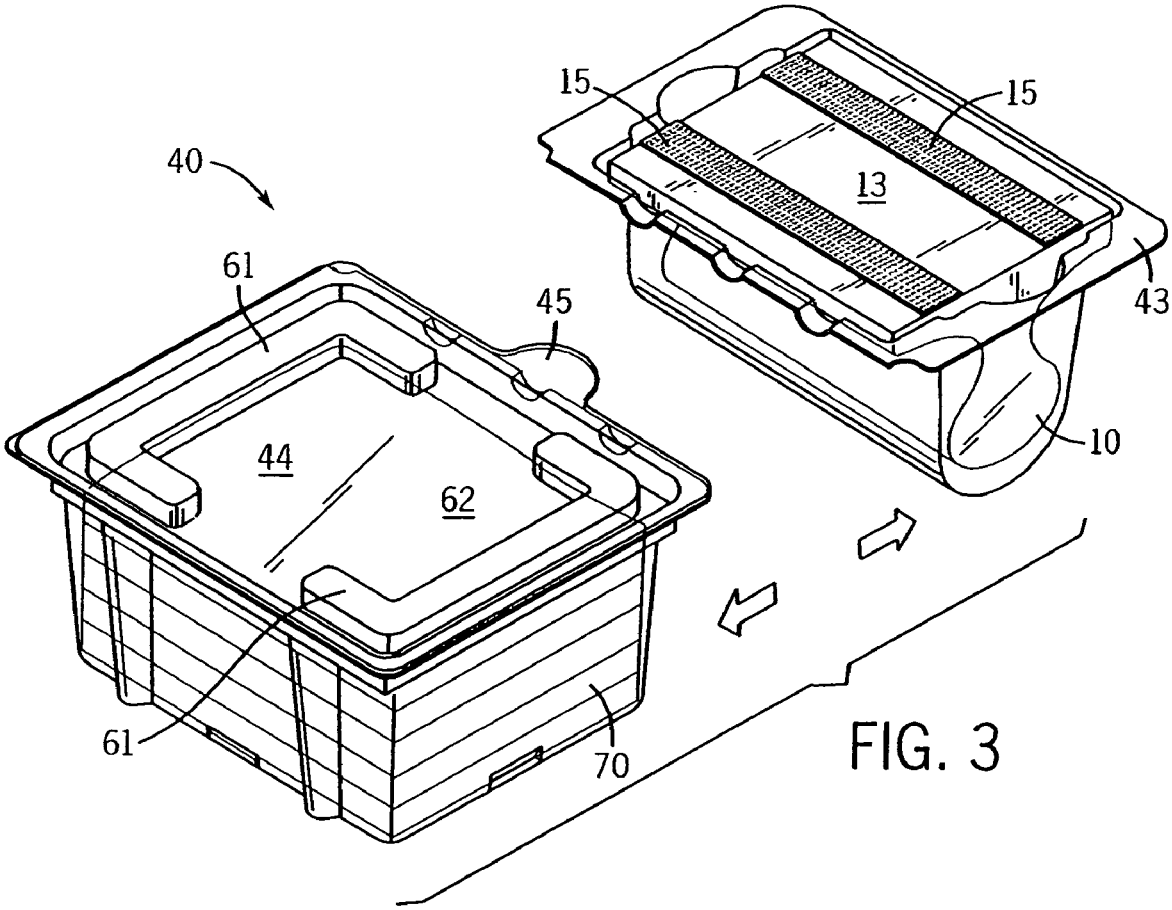
FIG. 3 is a view similar to the bottom portion of FIG. 2, but showing how container portions can be separated from each other.
Figure 11:
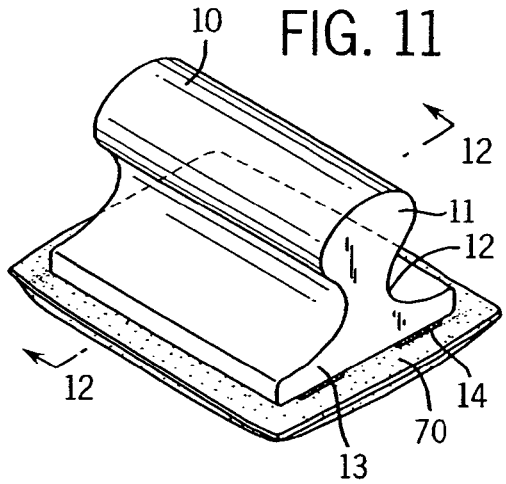
FIG. 11 is a view similar to the handle portion of FIG. 8, but showing additional portions of an attached pad.

As FIG. 11 shows, the handle 10 has an upper generally cylindrical head 11 linked by a neck 12 to a generally rectangular and flat base 13. Hook fastener type material (for example the hook side of Velcro® brand fastener material) 14 can be affixed via adhesive in parallel strips 15 to the base 13 (see FIG. 3).

C. Container

As best understood from FIGS. 2, 5, 6 and 8, container 40 is provided to ship, display, and store the handle and pads. It has a top/front cardboard panel 41 that is designed to contain various advertising and information regarding the product and its use. It may be removably affixed via an adhesive to rim 43 of a unitary plastic molded shell 42. The shell 42 can be molded from a plastic conventionally used for blister pack or clam shell type packages.

The shell 42 has three main sections, a pivotable cover 44 having a tab 45, a deep well 46, and a secondary well 47. The secondary well is sized such that it can receive the handle 10 in upside down fashion, in a tight fit. There is a wide top section 48 that mimics the handle base dimensions, and a deep recess 49 which mimics the handle top shape. There is also a perforation/weakening line 50 which extends between the deep well 46 section and the secondary well 47 section.

Figure 4:
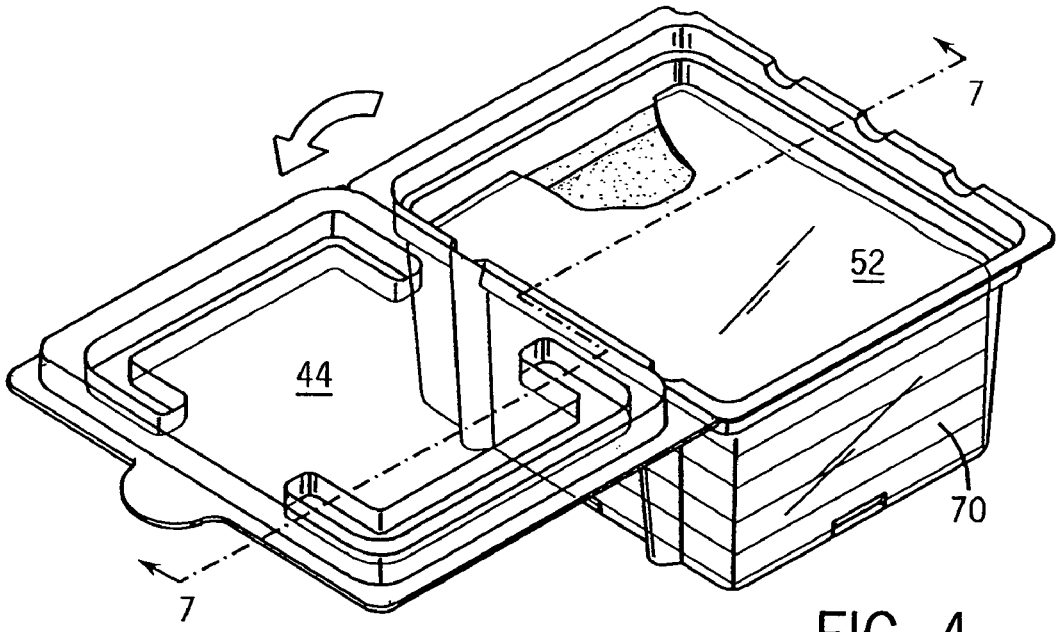
FIG. 4 is a view similar to the left portion of FIG. 3, but showing a cover of the container in an open position.

The deep well 46 may house a plastic pouch 52 (see FIG. 4) in which is retained a stack of the replacement pads 70 (for example 6 to 20). After swinging the cover 44 to an open position, a consumer can remove the pouch 52 from the deep well 46, cut it open with a scissors, remove the stack of pads 70 from the pouch 52, and replace the stack into the deep well with top layer 72 of each pad placed in an upward direction. A consumer can then separate the secondary well section from the deep well section by tearing them apart by hand, remove the handle 10 from the secondary well 47, and thereafter throw away that well 47.

Figure 7:
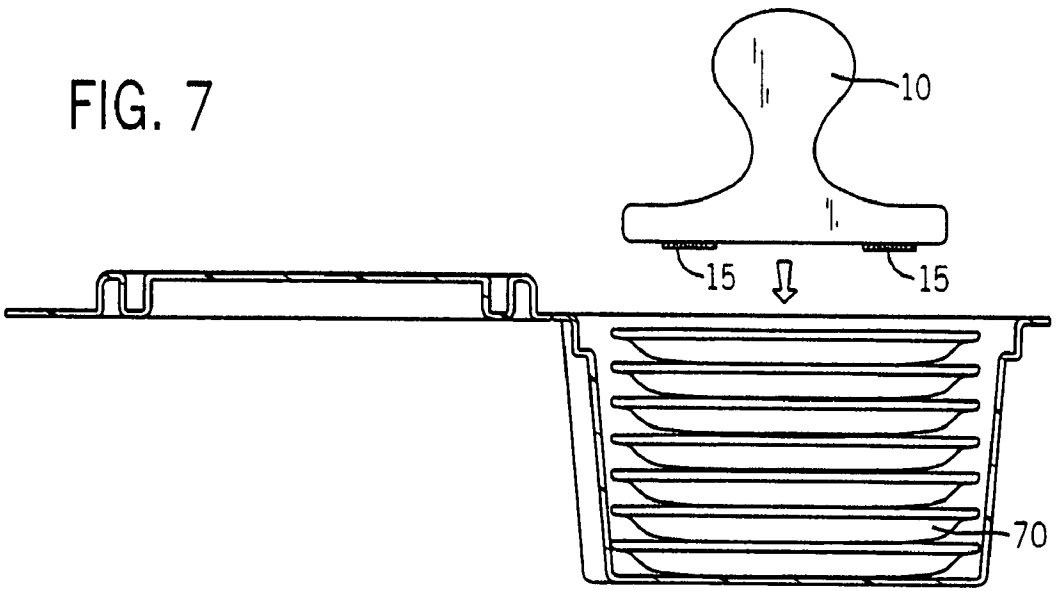
FIG. 7 is a view taken along line 7-7 of FIG. 4, but with an adjacent handle shown, and the pads having been removed from their shipping pouch and reinserted in the well.
Figure 8:
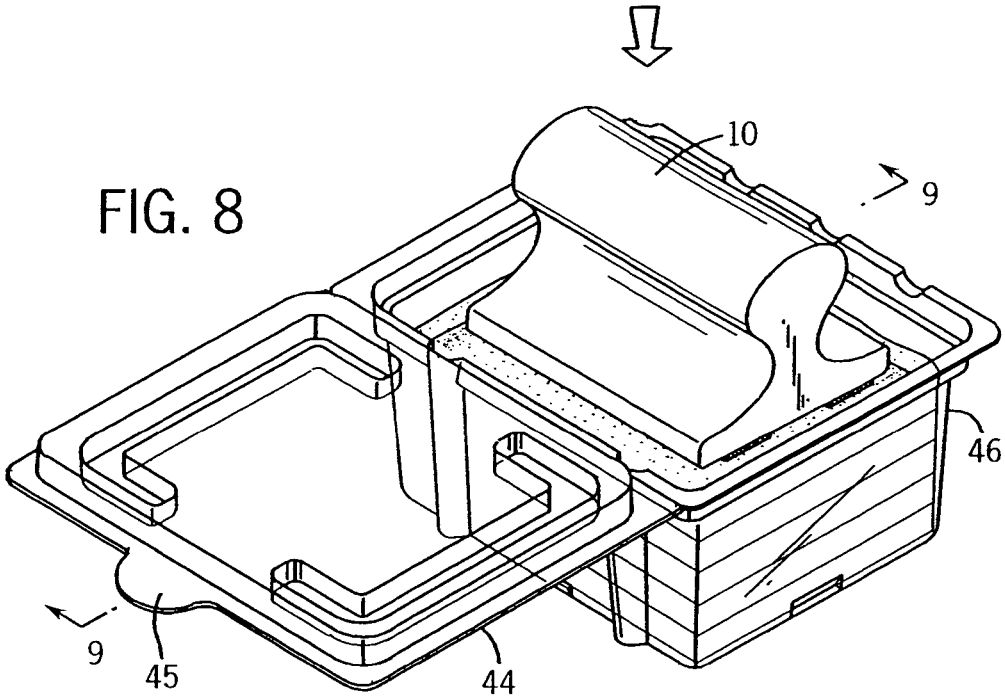
FIG. 8 is a view similar to FIG. 4, but with a handle shown positioned on a stack of the pads.
Figure 13:
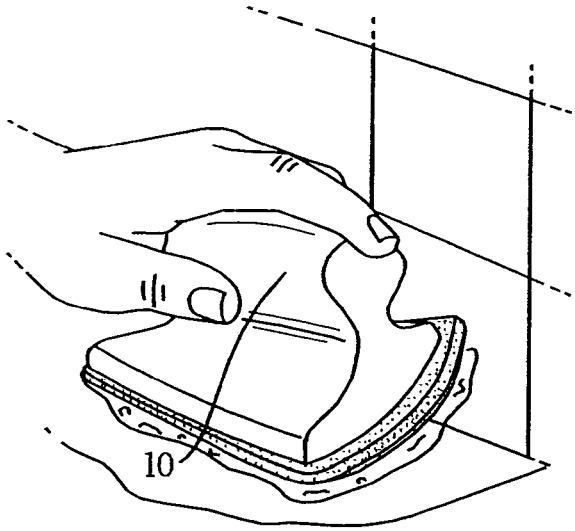
FIG. 13 is a perspective view depicting how the FIG. 11 handle can be used and can flex during use.
Figure 9:
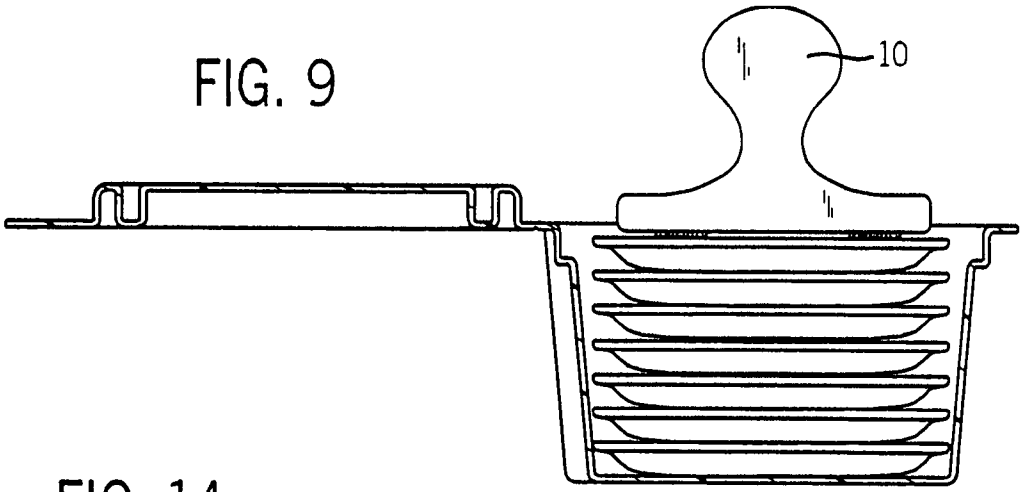
FIGS. 9 and 10 are similar to FIG. 7, but with a handle and/or a pad shown in different positions to represent continued stages of use.
Figure 10:
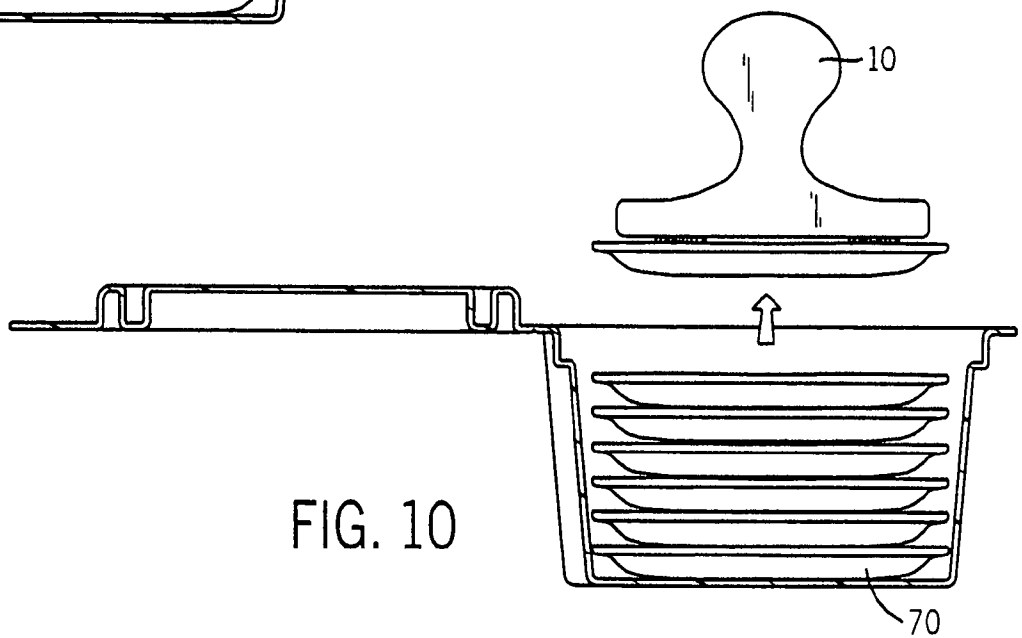

As shown in FIGS. 7-9, the parallel strips/fastening means 15 on the bottom of the handle 10 can then be pushed down on the top layer 72 of a pad at the top of the stack, thereby automatically attaching the pad to the handle. This creates an assembly that functions as a scrubbing device as shown in FIGS. 10, 11 and 13. The cover 44 can reclose the deep well 46 (preventing the rest of the unused pads from prematurely drying out).

Prior to use it is preferred that the pad of FIG. 11 be exposed to water briefly to help initiate migration of the cleaning liquid to the surface of the pad. This will preferably create a tenfold or more dilution of the impregnating chemical.

One preferred technique is to wet the pad under running water (for example warm water for about two seconds). The pad can then be used for scrubbing while delivering cleaning solution for about a half minute, and in some cases even up to one minute. The pad can then be wetted again (in similar fashion), and used for a similar time period. Pads of the present invention have been successfully used for four or more such cycles while still delivering adequate amounts of acid and surfactant.

The top of the cover 44 is provided with ribs 60, such that after using the device, one can tear off a used pad 70 from the handle 10, and then place the handle by itself into the docking area 62 defined by those ribs. This provides a desirable place for a consumer to store the handle.

Figure 14:
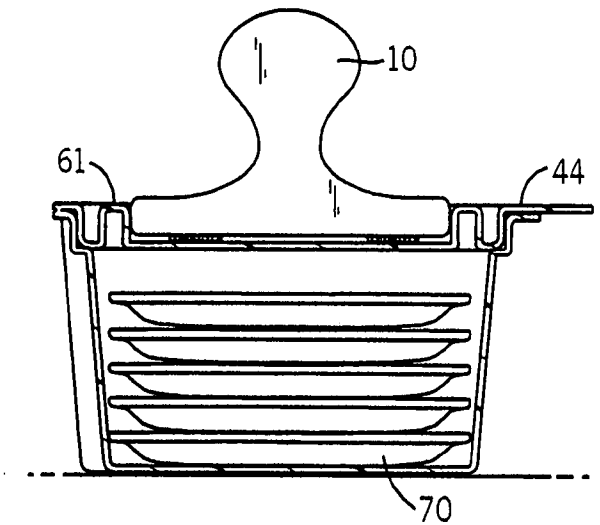
FIG. 14 shows how the handle, with pad removed, can be stored on the left portion of the FIG. 3 container between uses.

The base 13 of the handle 10 can be sized relative to the area 62 so as to be able to tightly jam in between the ribs 61. If so, the handle subassembly with the FIG. 14 container portion can be transported merely by lifting the handle head 11, without needing to hold the container 40 from the bottom.

Figure 5:
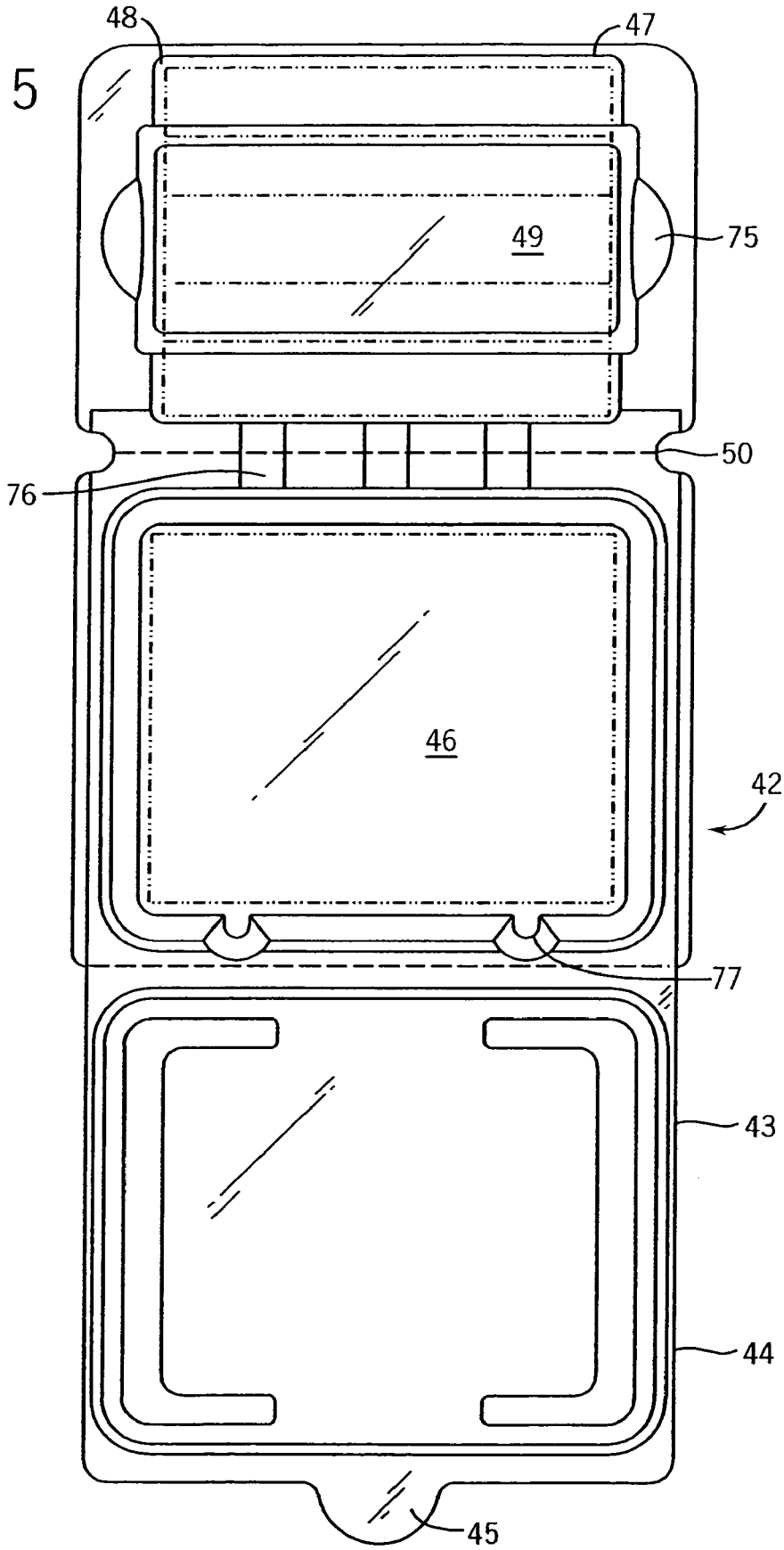
FIG. 5 is a top plan view of the bottom portion of FIG. 2, but with the cover open and the handle and pads removed.
Figure 6:
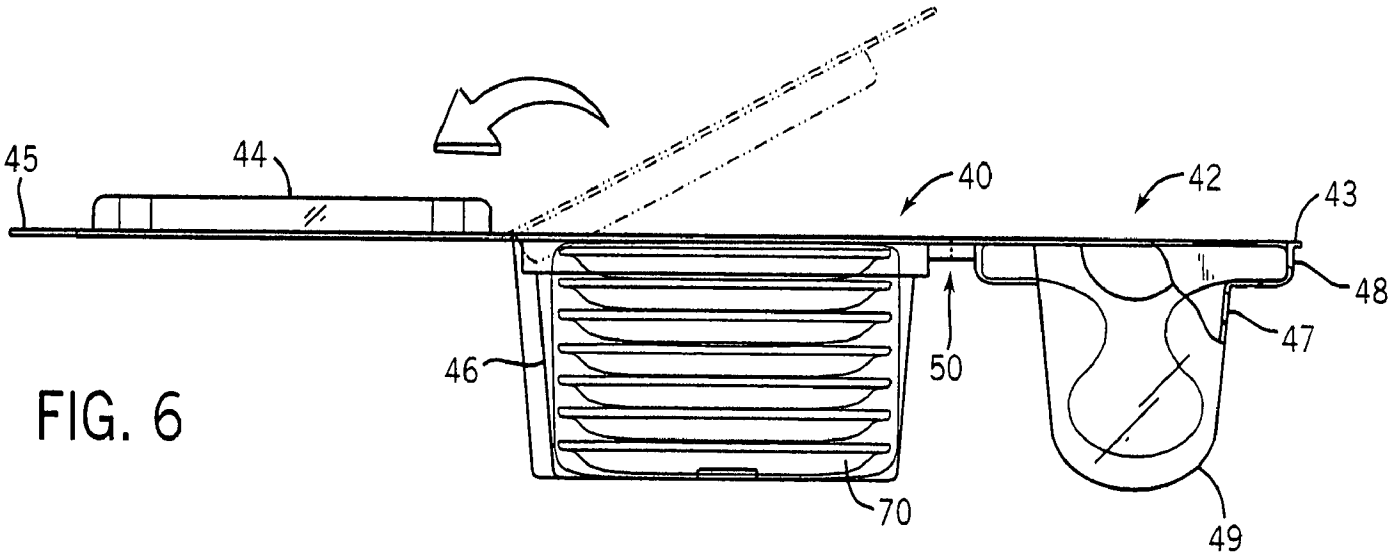
FIG. 6 is a side elevational view of the FIG. 5 structure, showing the handle and pads in the container.

A variety of other refinements could also be made to the container. For example, to facilitate molding various depressions 75, 76 and 77 can be formed in the plastic as shown in FIG. 5. Moreover, the presence of depressions 76 can serve to equalize air pressure in the wells 46 and 47 when the product is in the FIG. 1 form.

While FIG. 5 shows one preferred embodiment of the container, the container may instead take other forms. For example, it might instead be a clam shell type box having a lower base for holding both the handle and pads together in a single container, and a cover hinged thereto by a living hinge so as to close the base.

D. Cleaning Pad

A preferred cleaning pad 70 of the present invention is a multi-layer structure. Top layer 72 of the pad functions as a loop type material (for example in a Velcro® type assembly) without the need for a separate loop strip. It is most preferably polyester spunlaced nonwoven fabric mounted on a polyethylene extrusion film, such as sold by Ahlstrom as Grade 26024. See FIG. 12. However, a variety of other fibrous type materials would also suffice. Thus, in a preferred form, it is to be understood that in FIG. 12 the top line of layer 72 represents the spun laced polyester, while the bottom line of layer 72 represents the polyester film backing for the spun laced polyester.

Middle layer 73 can be sonically welded to the top layer around the periphery of the pad and is preferably an absorbent material, more preferably an absorbent at least partially synthetic material, most preferably Ahlstrom Grade 12236 (which is a non-woven fabric formed from a pulp/synthetic mix). Layer 73 of the pad can be impregnated with a concentrated liquid cleaning formula such as one containing glycol ethers, lactic acid, nonionic surfactant, and fragrance. A subassembly of the layers 72 and 73 can be sonically welded around their periphery to abrasive layer 74. Alternatively the pads could be heat sealed or needle punched so as to bind them together.

One possible abrasive/lower layer is a 100% polyester/acrylic resin. Another possible abrasive/lower layer is a mix of cellulose and polyolefins. Regardless, the lower layer should be capable of providing a scrubbing, rather than just polishing, wiping or drying, function. This can be achieved by adding abrasive materials to a smooth material, or by forming a layer comprised of an abrasive material. In any event, it is preferred that the abrasive layer be somewhat thicker than the other two layers. Particularly desirable abrasives are formed from highly porous material such as air filter material. This material also serves to aerate cleaning liquid as it is dispensed, thereby causing desirable foaming.

Because the middle layer 73 is impregnated with a liquid (preferably up to about 50 percent of the maximum absorbance capacity of the middle layer), it does not take very long for the surfactant to become evident to a consumer once the pad is briefly wetted under a faucet. However, the pad is not very wet to the touch prior to use since the outer layer is preferably not impregnated, and since the preferred impregnation liquid is very concentrated.

Figure 18:
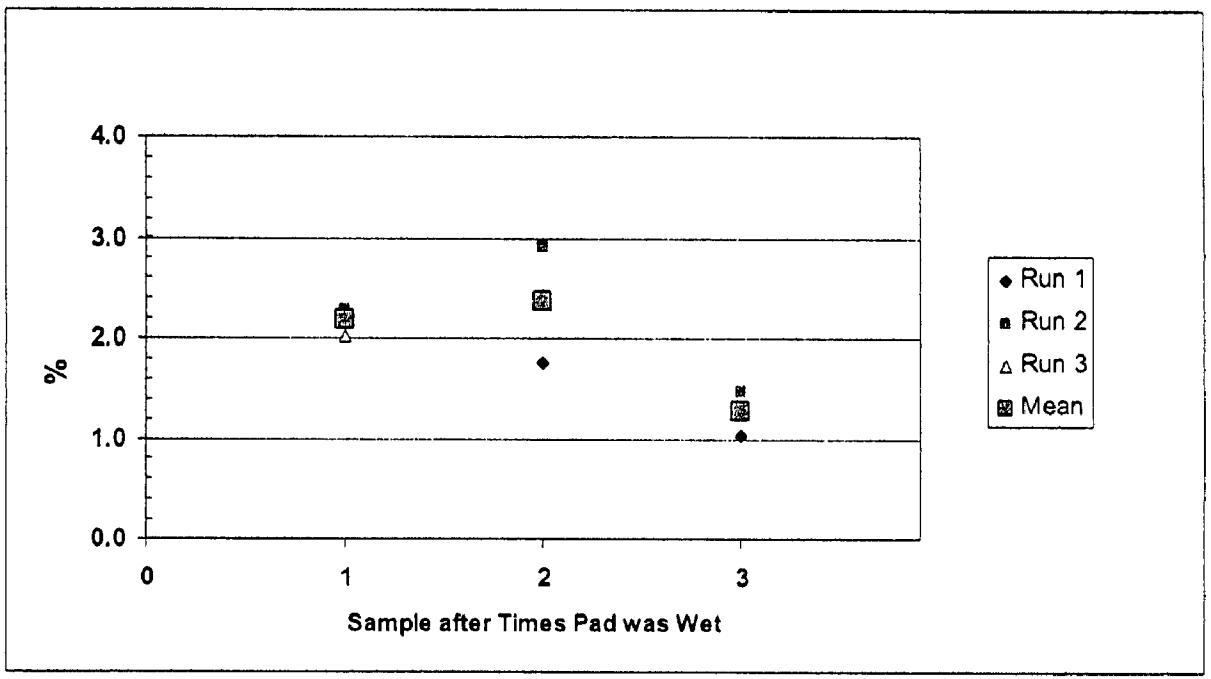
FIG. 18 is a graph showing how the preferred pad can be repetitively wetted, yet still release a desirable concentration of cleaning liquid.

A particularly desirable feature of the invention is that once the pad is wetted and it is scrubbed against a surface, as shown in the attached chart of FIG. 18, the pad can deliver a concentration of over 1 percent cleaner when first used. When the pad is then re-wetted, it will continue to deliver over 1 percent cleaner. Even after yet another re-wetting it will still deliver over 1 percent cleaner. Thus, the consumer can ha about that amount notwithstanding the re-wetting.

Yet another important feature of the middle layer of the pad is its surprisingly slow radial wicking attribute, notwithstanding its high absorbance. The middle layer is such that if 5 grams of water were dropped at (or within 1 centimeter of) the center of the pad it would take at least 1 minute, preferably at least 2 minutes, even more preferably at least 3 minutes, to wick the liquid to an edge of the pad. Hence, during production there is time for the top layer and bottom layer to be placed over and under the middle layer after impregnation of the middle layer, followed by welding of the layers together (or other adhesion) at their periphery, before the liquid wicks out past the weld.

E. Use Of System

To use the device one holds the handle 10 by its head 11 after a pad 70 has been attached to its bottom (see FIGS. 11 and 13). The pad can then be pushed against a tile wall, bathtub or the like in scrubbing fashion. After use a soiled pad 70 can be disposed of and a fresh pad can replace it immediately prior to further cleaning. Once the stack of pads has been exhausted (and the last pad has been used), the handle is inexpensive enough that it is practical to also be disposed of.

The consumer is provided with a convenient and compact location for storing the handle between uses. Further, a shipping well is provided for the handle before it is used. The container has an optimal size for each of its functions.

The cleaning pads are effective for a scrubbing brush function, yet are suitable to carry cleaning chemicals. Thus, the system is an "all-in-one" system which does not require use of a separate cleaner.

The above description has been that of a preferred embodiment of the present invention. It will occur to those that practice the art, however, that still other modifications may be made without departing from the spirit and scope of the invention. For example, the cleaning formula may be less concentrated, or may be a dry power, or not be present at all. Further, other attachment systems/fastening means (besides hook/loop type systems) for easily connecting the handle to a replacement pad may be used (for example adhesive, hook and slot).

Figure 15:
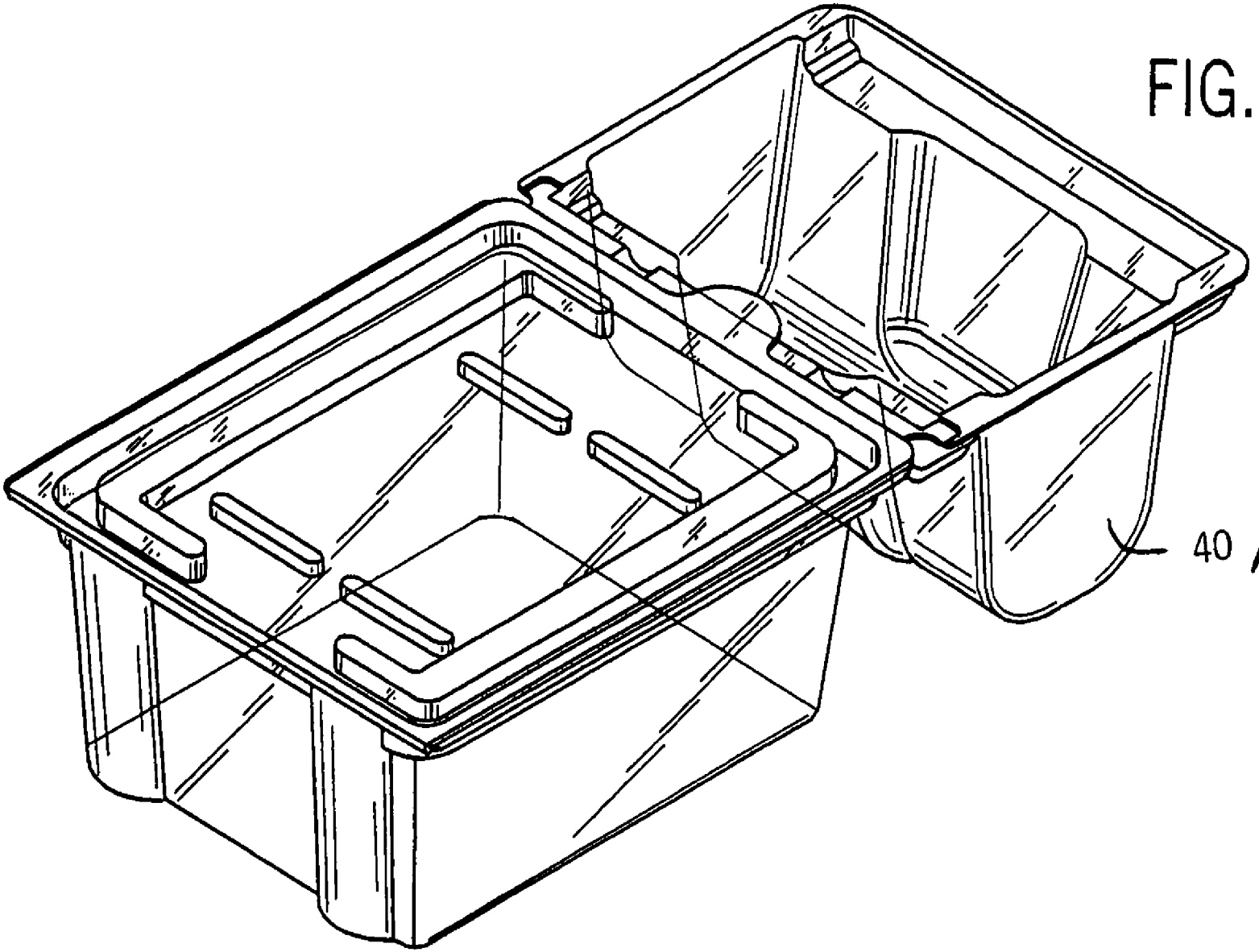
FIG. 15 is a left, top, front perspective view of a second embodiment shown with a display cardboard, handle, and cleaning pads already removed, the second embodiment being shown from an angle similar to that of FIG. 2.
Figure 16:
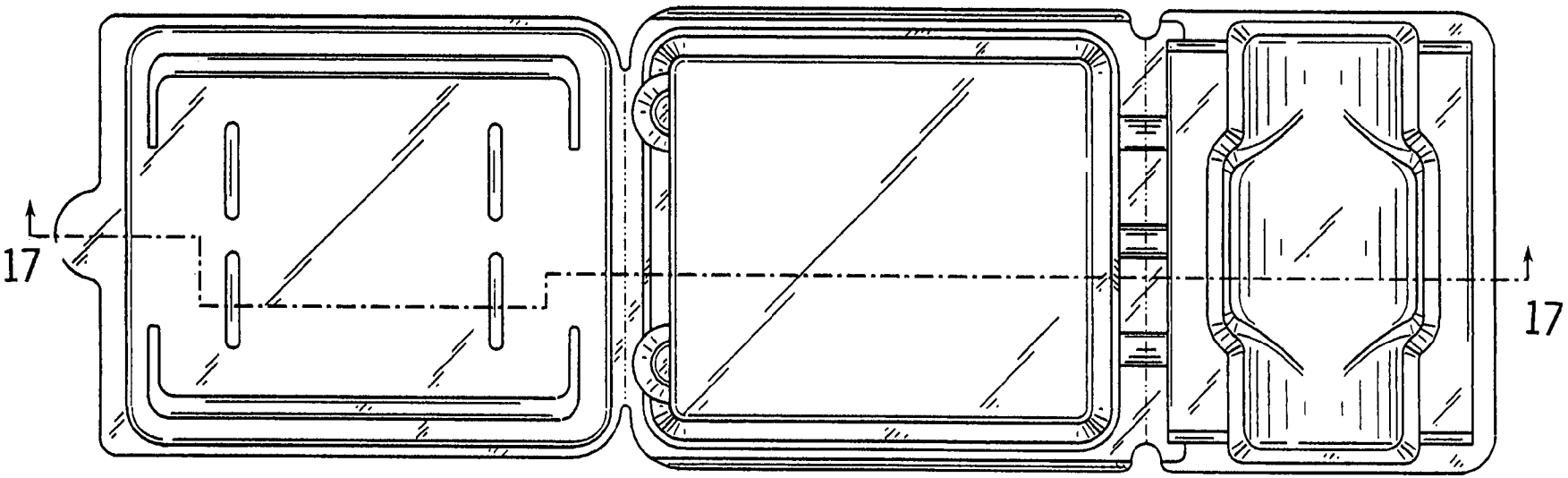
FIG. 16 is a top plan view thereof, but showing a hinged cover thereof swung out to an open position.
Figure 17:
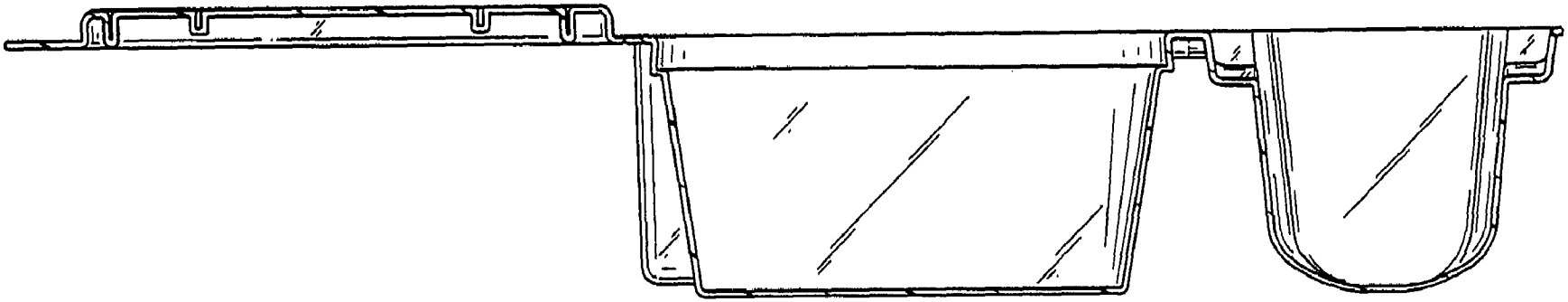
FIG. 17 is a vertical sectional view taken along line 17-17 of FIG. 16.

As another example, a somewhat revised container 40A is shown in FIGS. 15-17. This container has a longitudinal axis of the cleaning pad well formed perpendicular to the longitudinal axis of the handle well. This permits a somewhat more sleek appearance than the FIG. 1 embodiment, but otherwise functions essentially the same as the first embodiment.

Hence, the full scope of the invention should not be judged by the preferred embodiments. Rather, the following claims should be looked to in order to judge the full scope of the invention.

INDUSTRIAL APPLICABILITY

The present invention provides replacement pads, handles and containers for use in an improved cleaning/surface treatment system.

The invention claimed is:

1. A multi-layer surface treating pad, comprising:

an upper layer suitable to serve as one part of a hook/loop type fastener system;

an interior layer comprising a mix of pulp and synthetic material that is impregnated with a liquid surface treating formula; and a lower layer which comprises an abrasive material;

wherein the pad is a cleaning pad and the formula comprises an acid; and wherein when the pad is first wetted with water it can release a cleaning solution of at least 1 percent acid by weight, and when that same pad is then wetted a second time with water it can still release a cleaning solution of at least 1 percent acid by weight, and when that same pad is thereafter wetted a third time with water it can still release a cleaning solution of at least 1 percent acid by weight.

2. The pad of claim 1, wherein the upper layer is suitable to serve as a loop part of a hook/loop type fastener system.

3. The pad of claim 1, wherein the upper, interior and lower layers are welded together.

4. The pad of claim 3, wherein the upper, interior and lower layers are welded together around their periphery so that the pad is thicker at its center than at its periphery.

5. The pad of claim 1, wherein the upper, interior and lower layers are needle punched together around their periphery.

6. The pad of claim 1, wherein the pad comprises a carrier liquid and a surfactant.

7. The cleaning pad of claim 1, wherein the interior layer of the pad is such that prior to said impregnation the interior layer had a wicking characteristic such that when that the interior layer prior to impregnation had been positioned horizontally and 5 grams of 25° C. water was placed at a center, or within 1 centimeter of the center, of a top surface of the interior layer, that water would not reach a peripheral boundary of the interior layer prior to 1 minute after the 5 grams of water were so placed.

8. The cleaning pad of claim 1, wherein the formula has less than 30 percent water by weight.

9. The cleaning pad of claim 1, wherein the lower layer is configured so as to be capable of aerating the formula when the formula has been diluted with water, to thereby cause a resulting diluted formula to foam.

10. The pad of claim 1, wherein an absorption capacity of the interior layer prior to impregnation with the formula was over 500% of its starting weight.

11. The pad of claim 1, wherein the impregnating formula occupies less than 50 percent of an absorption capacity of the interior layer.

12. The pad of claim 1, wherein the lower layer comprises a layer of air filter media.

13. The pad of claim 1, wherein the upper layer comprises polyethylene film to enhance its structural integrity.

14. A multi-layer surface treating pad, comprising:

an upper layer suitable to serve as one part of a hook/loop type fastener system;

an interior layer comprising a mix of pulp and synthetic material that is impregnated with a surface treating formula; and a lower layer which comprises an abrasive material;

wherein the pad is a cleaning pad and the formula comprises a carrier liquid and a surfactant; and wherein the formula comprises a glycol ether and a nonionic surfactant.

15. A multi-layer surface treating pad, comprising:

an upper layer suitable to serve as one part of a hook/loop type fastener system;

an interior layer comprising a mix of pulp and synthetic material that has been impregnated with a liquid surface treating formula; and a lower layer which comprises an abrasive material;

wherein the upper, interior and lower layers are attached together around their periphery so that the pad is thicker at its center than at its periphery;

wherein the upper layer was placed on the interior layer after impregnation of the interior layer with the liquid surface treating formula.

* * * * *

UNITED STATES PATENT AND TRADEMARK OFFICE

CERTIFICATE OF CORRECTION

PATENT NO. : 7,610,647 B2
APPLICATION NO. : 11/129132
DATED : November 3, 2009
INVENTOR(S) : Morgan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1054 days.

Signed and Sealed this

Twelfth Day of October, 2010

David J. Kappos

David J. Kappos
*Director of the United States Patent and Trademark Office*